US008905501B2

(12) United States Patent
Lee et al.

(10) Patent No.: US 8,905,501 B2
(45) Date of Patent: Dec. 9, 2014

(54) REFRIGERATOR

(75) Inventors: Eunjoo Lee, Changwon-si (KR); Hangbok Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 158 days.

(21) Appl. No.: 13/504,196

(22) PCT Filed: Jan. 19, 2011

(86) PCT No.: PCT/KR2011/000376

§ 371 (c)(1),
(2), (4) Date: Apr. 26, 2012

(87) PCT Pub. No.: WO2011/093615

PCT Pub. Date: Aug. 4, 2011

(65) Prior Publication Data

US 2012/0229010 A1 Sep. 13, 2012

(30) Foreign Application Priority Data

Feb. 1, 2010 (KR) ..... 10-2010-0008979

(51) Int. Cl.
*A47B 96/00* (2006.01)
*F25D 23/04* (2006.01)
*F25D 25/02* (2006.01)

(52) U.S. Cl.
CPC ..... *F25D 25/025* (2013.01)
USPC ..... 312/404; 312/333; 62/382

(58) Field of Classification Search
USPC ..... 312/401, 405, 405.1, 408, 402, 404, 312/291, 292, 330.1, 333, 334.44; 62/382, 62/440
See application file for complete search history.

(56) References Cited

U.S. PATENT DOCUMENTS 1,984,977 A * 12/1934 Mize ..... 312/276
2,129,923 A * 9/1938 Frankel ..... 312/236
2,150,064 A * 3/1939 John et al. ..... 62/266
2,306,802 A * 12/1942 Harbison ..... 62/382

(Continued)

FOREIGN PATENT DOCUMENTS

JP 11-218380 8/1999
KR 10-2002-0068929 8/2002
KR 10-2006-0022608 3/2006

OTHER PUBLICATIONS

International Search Report issued in PCT Application No. PCT/KR2011/000376 dated Sep. 19, 2011.

*Primary Examiner* — James O Hansen
(74) *Attorney, Agent, or Firm* — KED & Associates, LLP

(57) ABSTRACT

Disclosed herein is a refrigerator including: a main body configured to define a storage camber; a main door rotatably coupled to the main body; a sub door provided between the main body and the door and rotatably coupled to the main body, the main door being rotated independently of the sub door and the sub door being rotated along with the main door; a storage box received in the storage camber to be drawn out therefrom; a fixing rail fixed to one side of the storage camber; a moving rail provided to be movable along the fixing rail and moving along with the storage box; and restraining means provided in one side of a part configured to move integrally along with the storage box and in one side of a part formed integrally with the storage camber and configured to allow the storage box to be selectively drawn out from the storage camber when a press manipulation is conducted and released on the storage box.

10 Claims, 5 Drawing Sheets

(56) References Cited

U.S. PATENT DOCUMENTS

| | | | | | |
|---|---|---|---|---|---|
| 2,942,438 | A * | 6/1960 | Schmeling | 62/377 |
| 2,945,733 | A * | 7/1960 | Malia | 312/200 |
| 3,086,830 | A * | 4/1963 | Malia | 312/200 |
| 3,744,270 | A * | 7/1973 | Wilcox | 62/344 |
| 4,013,434 | A * | 3/1977 | Kronenberger et al. | 62/382 |
| 4,732,014 | A * | 3/1988 | Frohbieter | 62/382 |
| 5,261,737 | A * | 11/1993 | Faust et al. | 312/334.46 |
| 5,366,284 | A * | 11/1994 | Baker et al. | 312/404 |
| 5,632,541 | A * | 5/1997 | Uthoff | 312/333 |
| 7,406,833 | B2 * | 8/2008 | Ertz et al. | 62/115 |
| 7,631,514 | B2 * | 12/2009 | Kim et al. | 62/344 |
| 7,695,080 | B2 * | 4/2010 | Chen et al. | 312/333 |
| 2003/0151340 | A1 * | 8/2003 | Mathur et al. | 312/408 |
| 2004/0056573 | A1 * | 3/2004 | Chae | 312/404 |
| 2004/0183415 | A1 | 9/2004 | Kim | |
| 2006/0103279 | A1 * | 5/2006 | Lai | 312/333 |
| 2006/0152119 | A1 * | 7/2006 | Park | 312/404 |
| 2009/0261700 | A1 * | 10/2009 | Chen et al. | 312/334.46 |

* cited by examiner

REFRIGERATOR

TECHNICAL FIELD

The present invention relates to a refrigerator.

BACKGROUND ART

Generally, refrigerators are home appliances for freshly storing foods for a predetermined time by repeatedly running a freezing cycle to cool a refrigerating compartment and a freezing compartment.

The refrigerator includes a main body that defines a storage space and a door that selectively shields the main body. Stocks are received in the storage space, and a user can open the door in order to take out the stocks.

A storage box in which the stocks are received may be provided in the main body. The storage box may be provided to be drawn out from the storage space.

Meanwhile, according to existing refrigerators, there is a problem in that it is not easy to draw out from or draw in inside the storage box.

For example, when many stocks are received in the storage box and therefore, the storage box is heavy, it is not easy to move the storage box by a user.

Furthermore, when a force applied on the storage box is not balanced in left and right or upper and lower directions, the storage box is interference with the inner surface of the main body, so that not only the storage box may not be easily drawn in or out but also the storage box may be damaged upon the drawing out of it.

In particular, there is a problem in that the storage box is easily not drawn out because of interference with the main body when the storage box that had been drawn in the inside of the main body is drawn out forward.

When the drawing in or out of the storage box is not smoothly conducted, the time for which the door of the refrigerator is opened is increased in order to manipulate the storage box, so that there is a problem in which power consumption is increased.

As a result, there are problems in that the user suffers inconvenience in manipulating the storage box and the reliably for products is decreased.

DISCLOSURE OF INVENTION

Technical Problem

The present invention has been made in an effort to solve the problems and it is an object of the present invention to provide a refrigerator in which a storage box can be smoothly drawn in/out.

Another object of the present invention is to provide a refrigerator in which a storage box can be easily drawn in/out by the manipulation of pressing the storage box.

Solution to Problem

An exemplary embodiment of the present invention provides a refrigerator including: a main body configured to define a storage camber; a main door rotatably coupled to the main body; a sub door provided between the main body and the door and rotatably coupled to the main body, the main door being rotated independently of the sub door and the sub door being rotated along with the main door; a storage box received in the storage camber to be drawn out therefrom; a fixing rail fixed to one side of the storage camber; a moving rail provided to be movable along the fixing rail and moving along with the storage box; and restraining means provided in one side of a part configured to move integrally along with the storage box and in one side of a part formed integrally with the storage camber and configured to allow the storage box to be selectively drawn out from the storage camber when a press manipulation is conducted and released on the storage box.

Advantageous Effects of Invention

According to the refrigerator according to the embodiments of the present invention, a plurality of rails to guide the drawing in/out of the storage box are provided so that there is an advantage in that the drawing in/out of the storage box is smoothly conducted.

Furthermore, when the storage box is drawn in, the storage box is easily fixed to the inside of the main body of the refrigerator and when the front of the storage box is pressed in the state in which the storage box has been drawn in, the storage box is easily drawn out forward.

Furthermore, the engagement of the storage box and the moving rail is easily released by manipulating a handle provided in the storage box and, accordingly, the storage box can be completely separated from the moving rail.

Furthermore, since the storage box is easily separated from the moving rail, the cleaning for the storage box is easily conducted.

BRIEF DESCRIPTION OF DRAWINGS

The above and other objects, features and advantages of the present invention will become apparent from the following description of preferred embodiments given in conjunction with the accompanying drawings, in which.

MODE FOR THE INVENTION

Exemplary embodiments of the present invention will now be described in detail with reference to the accompanying drawings. However, the spirit of the present invention is not limited to the described embodiments, and other embodiments may be easily made by those skilled in the art understanding the spirit of the present invention within the scope of this invention.

Figure 1:
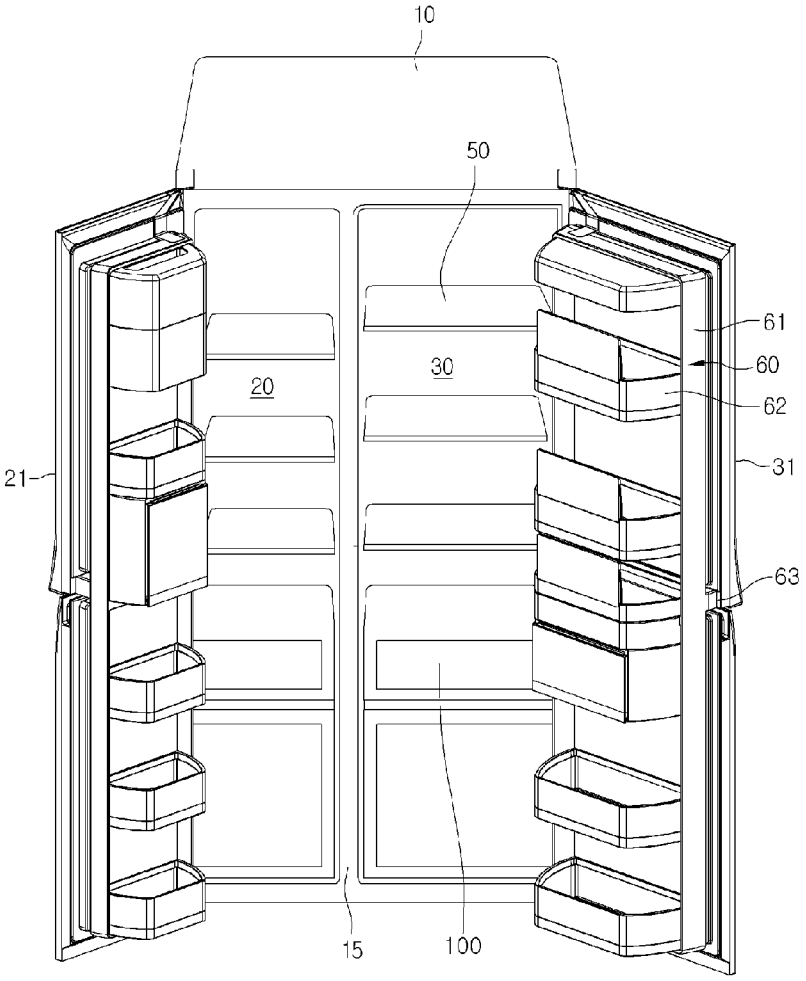
FIG. 1 is a perspective view of a refrigerator according to an embodiment of the present invention.

FIG. 1 is a perspective view of a refrigerator according to an embodiment of the present invention.

Referring to FIG. 1, the refrigerator 1 of the embodiment of the present invention includes a main body 10 defining a freezing compartment 20 and a refrigerating compartment 30 as storage chambers. The freezing compartment 20 and the refrigerating compartment 30 are resulted from partitioning by a partition wall 15 and are arranged in parallel to each other. Furthermore, a first receiving part 50 for receiving stocks is formed in the inside of the freezing compartment 20 and the refrigerating compartment 30.

The first receiving part 50 stores stocks, and includes a storage box 100 that is provided to be able to be drawn out forward therefrom.

A freezing compartment door 21 and a refrigerating compartment door 31 which respectively shield the freezing compartment 20 and the refrigerating compartment 30 are provided in the front of the main body 10. The freezing compartment door 21 and the refrigerating compartment door 31 are respectively provided in plural number, and may be rotatably coupled to the main body 10.

A second receiving part 60 that stores stocks is provided in the rear of the freezing compartment door 21 and the refrigerating compartment door 31. The second receiving part 60 may be rotatably coupled to the main body 10.

Furthermore, the second receiving part 60 may be rotated forwardly along with the freezing compartment door 21 or the refrigerating compartment door 31, and is disposed to be received inside the main body 10 in the state in which the freezing compartment door 21 and the refrigerating compartment door 31 have been opened.

More specifically, the second receiving part 60 includes a frame 61 that has a square shape and a basket 62 that is fixedly or removably coupled to the frame 61. Furthermore, when the refrigerating compartment door 31 has been only opened, the front edge part of the second receiving part 60 is retained to be in close contact with the front edge part of the refrigerating compartment 30. Furthermore, the basket 62 is retained in a state in which it is received inside the refrigerating compartment 30. Furthermore, a handle 63 may be formed on the front surface of the second receiving part 60 and the handle 63 may be structured to be covered by the refrigerating compartment door 31. As shown in the drawing, the refrigerating compartment door 31 includes two doors respectively provided in the upper side and the lower side thereof. The handle 63 of the second receiving part 60 may be located in the rear surface of the lower end of the upper refrigerating compartment door 31 and be prevented from being exposed to the outside when the upper refrigerating compartment door 31 has been closed.

Furthermore, the handle 63 may have a pocket shape that is recessed upwardly. When the handle 63 is grasped and drawn forwardly, the upper and lower refrigerating compartment doors 31 are rotated along with the second receiving part 60 as a one-piece body and then the refrigerating compartment 30 may be opened. Similarly, the freezing compartment may be configured such that two doors 21 are provided in the upper and lower portions thereof and the second receiving part is provided.

Furthermore, the refrigerating compartment door 31 is mounted to be rotated independently of the second receiving part 60. Accordingly, when the refrigerating compartment door 31 is only opened, the front part of the second receiving part 60 is opened. In this state, foods may be received in the basket 62 included in the second receiving part 60 or foods stored in the basket 62 may be taken out.

Due to this structure, the second receiving part 60 functions as a separate door having a separate receiving part. Accordingly, if the refrigerating compartment door 31 and the freezing compartment door 21 are defined as main doors, the receiving part 60 may be defined as a sub door.

Furthermore, the rotating axis of the second receiving part 60 and the rotating axis of the refrigerating compartment door 31 may be coaxial. That is, the second receiving part 60 and the refrigerating compartment door 31 may be structured to share one rotating axis.

The configuration of the storage box 100 and the structure in which the storage box 100 is drawn in and out are described with reference to the drawings.

Figure 2:
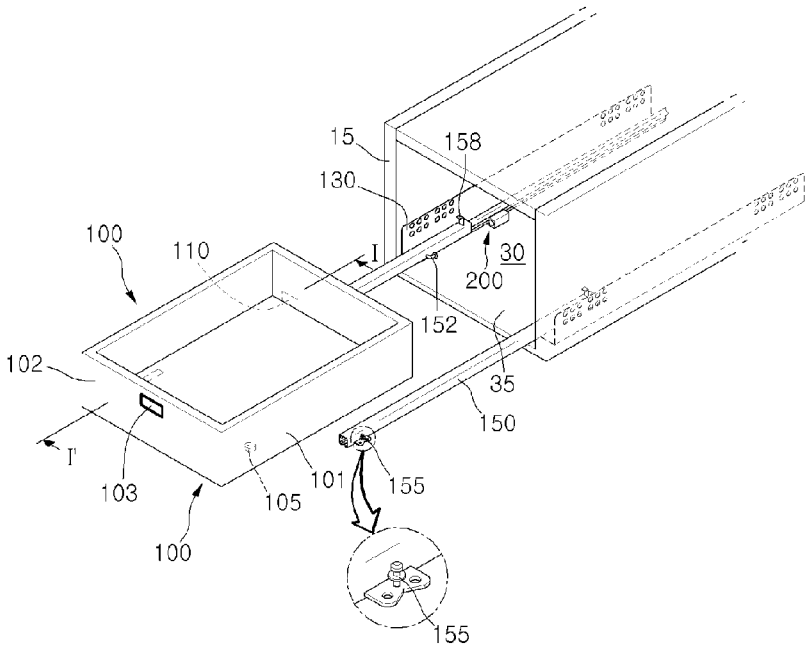
FIG. 2 is a perspective view showing a configuration of a refrigerating compartment according to an embodiment of the present invention.
Figure 3:
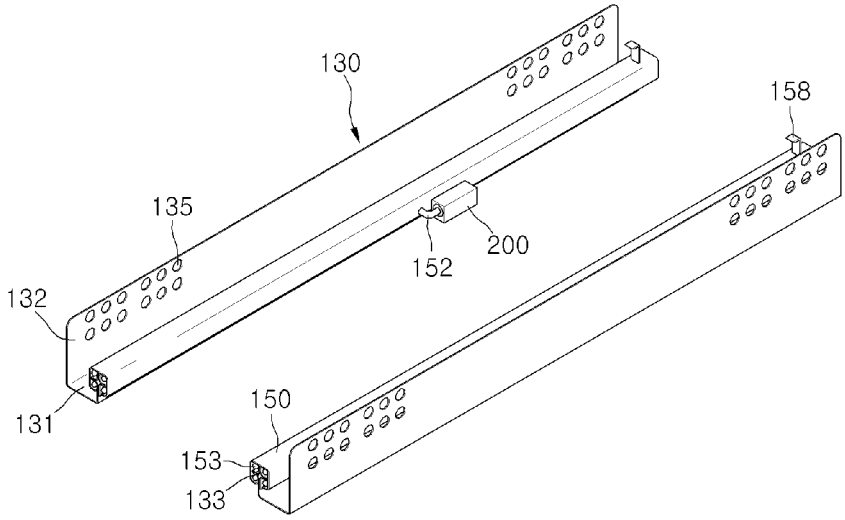
FIG. 3 is a diagram showing configurations of a fixing rail and a moving rail according to an embodiment of the present invention.
Figure 4:
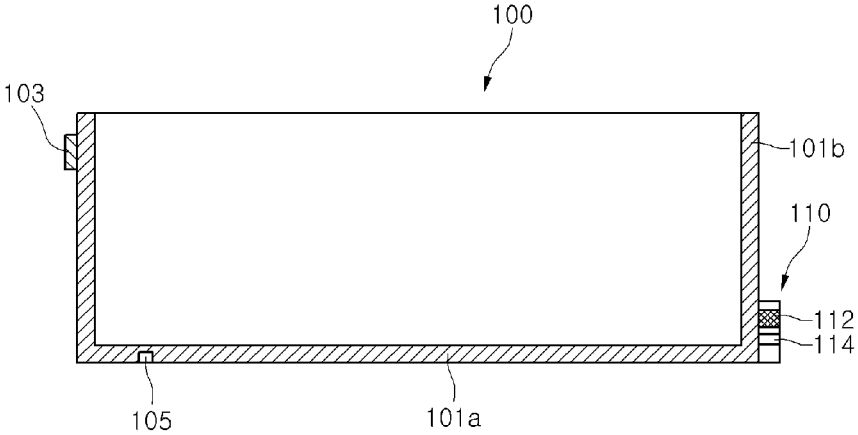
FIG. 4 is a cross-sectional view taken along line I-I' of FIG. 2.
Figure 5:
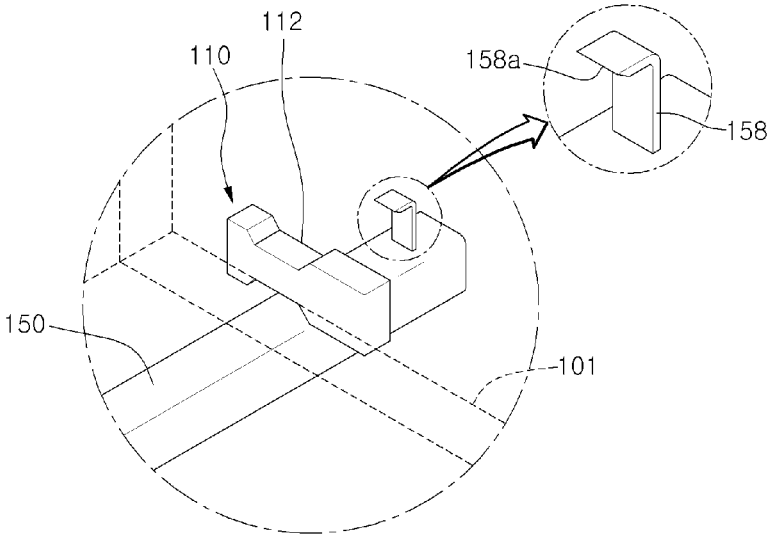
FIG. 5 is a diagram showing the engagement structure of a storage box and the moving rail according to an embodiment of the present invention.

FIG. 2 is a perspective view showing a configuration of a refrigerating compartment according to an embodiment of the present invention, FIG. 3 is a diagram showing configurations of a fixing rail and a moving rail according to an embodiment of the present invention, FIG. 4 is a cross-sectional view showing a configuration of the storage box according to an embodiment of the present invention, and, FIG. 5 is a diagram showing the storage box and the engagement structure of the moving rail according to an embodiment of the present invention.

Referring to FIGS. 2 to 5, the storage box 100 that is provided to be able to be drawn out and in, and a fixing rail 130 and a moving rail 150 that guide the movement of the storage box 100 are formed in the refrigerating compartment 30 according to the embodiment of the present invention. The fixing rail 130 is fixed to the inner wall of the refrigerating compartment 30. The moving rail 150 is coupled to the storage box 100 and can be moved forward and backward along the fixing rail 130.

Although it is shown that the storage box 100 is provided in the refrigerating compartment 30, the storage box 100 may be provided to be able to be drawn out from the freezing compartment 20.

More specifically, the fixing rail 130 includes a side surface coupling part 132 which is coupled to the inner surface of the main body 10, that is, the side wall of the refrigerating compartment 30 and a lower surface coupling part 131 which is curved from the side surface coupling part 132 and is coupled to the receptacle seating portion 35 of the refrigerating compartment 30.

The receptacle seating portion 35 is a portion to divide the space of the receiving part 50 and may be configured to support the lower side of the storage box 100.

A plurality of through holes 135 which is coupled thereto by separate fastening members is formed in the side surface coupling part 132 and the lower surface coupling part 131. The fastening members may be coupled to the inner surface of the main body 10 through the through holes 135.

The fixing rail 130 further includes a rail coupling part 133 which is coupled to the moving rail 150. The rail coupling part 133 is formed by upwardly bending the end of the lower surface coupling part 131 and is received inside the moving rail 150 through the opened lower part of the moving rail 150.

The moving rail 150 is provided to be movable along the fixing rail 130. Furthermore, the moving rail 150 is disposed to surround the circumference of the rail coupling part 133. A plurality of ball bearings 153 which allows the movement of the moving rail 150 to be smooth is interposed between the moving rail 150 and the rail coupling part 133.

The storage box 100 includes a receptacle body 101 that defines a storage space, and a receptacle front portion 102 that forms the front of the receptacle body 101.

The receptacle front portion 102 may be provided with a pressing portion 103 which can be manipulated to be pressed for the drawing in or out of the storage box 100. The pressing portion 103 may be provided as a separate member, or may be formed integrally with the receptacle front portion 102 as one portion which is manipulated to be pressed.

A coupling groove 105 that is coupled to the moving rail 150 is formed in the bottom portion 101*a* of the receptacle body 101. The coupling groove 105 is formed to be recessed upward from the bottom portion 101*a*. Furthermore, the coupling groove 105 is formed at a location closed to the front end thereof on the lower surface of the receptacle body 101, and may be provided respectively in the both sides of the receptacle body 101.

The moving rail 150 is provided with a coupling rib 155 that is received in the coupling groove 105. The storage box 100 may be fixed to the moving rail 150 due to the coupling to the coupling rib 155 of the coupling groove 105.

The rear portion 101*b* of the receptacle body 101 is provide with a rear engaging portion 110 which is engaged with the moving rail 150 in the state in which the storage box 100 has been coupled to the moving rail 150. Furthermore, the moving rail 150 is provided with an engagement rib 158 that is engaged with the rear engaging portion 110.

The rear engaging portion 110 includes an engagement end 112 which is engaged with the engagement rib 158 and a push protrusion 114 which is provided in one side of the engagement end 112 and selectively presses the engagement rib 158 in order to release the engagement of the engagement rib 158.

The engagement rib 158 includes an inclined portion 158*a* which is engaged with the upper portion of the engagement end 112. The inclined portion 158*a* is formed to be inclined downward from the upper end of the engagement rib 158 to guide the engagement of the engagement rib 158 and the engagement end 112. The inclined portion 158*a* allows the engagement rib 158 and the engagement end 112 to be smoothly engaged with each other.

The process of coupling the storage box 100 to the moving rail 150 is simply described below.

The rear engaging portion 110 is coupled to the engagement rib 158 by pressing the rear end of the storage box 100 against the engagement rib 158. That is, the engagement rib 158 is engaged with the upper side of the engagement end 112.

Furthermore, the front end of the storage box 100 is moved toward the moving rail 150 such that the coupling rib 155 is inserted into the coupling groove 105.

By the process, the front end and rear end of the storage box 100 may be easily fixed to the moving rail 150.

After the storage box 100 has been fixed to the moving rail 150 as describe above, the process in which the moving rail 150 is coupled to the fixing rail 130 by pushing the storage box 100 is described below.

Figure 6:
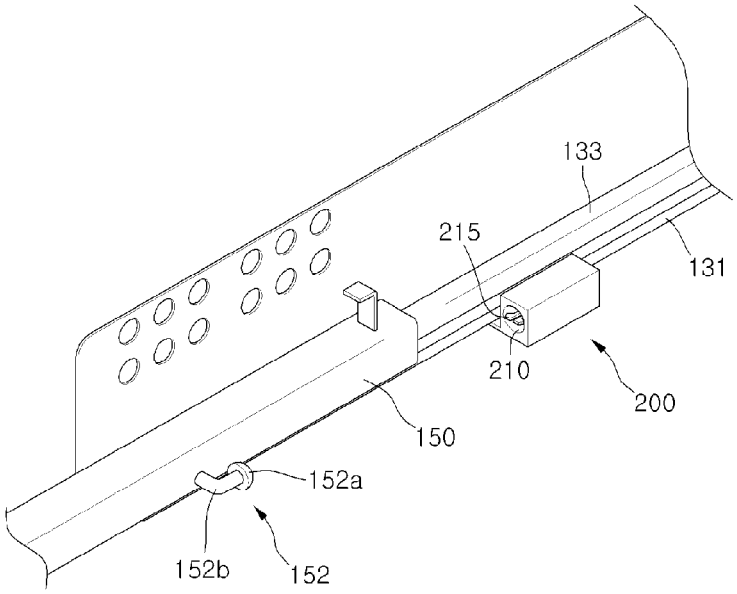
FIG. 6 is a diagram showing configurations of an opening apparatus and the moving rail according to an embodiment of the present invention.

FIG. 6 is a diagram showing configurations of an opening apparatus and the moving rail according to an embodiment of the present invention.

Referring to FIG. 6, the fixing rail 130 according to the embodiment of the present invention includes the lower surface coupling part 131 that is coupled to the receptacle seating portion 35 and the opening apparatus 200 that is extended from the lower surface coupling part 131 to the inner side of the refrigerating compartment 30. The opening apparatus 200 is located inside the rail coupling part 133.

The opening apparatus 200 includes an insertion part 210 into which the insertion member 152 of the moving rail 150 is inserted, and an engagement member 215 which is selectively engaged with the insertion member 152 upon the drawing in and out of the insertion member 152.

Furthermore, the insertion member 152 that is selectively coupled to the opening apparatus 200 is provided in one side of the moving rail 150 The insertion member 512 includes a protrusion part 152*a* which is inserted into the insertion part 210 and a rail connection part 152*b* that connects the protrusion part 152*a* to the moving rail 150. In this case, the insertion member 152 may be defined as a part of the moving rail 150.

The rail connection part 152*b* is extended to the inner side of the moving rail 150 and is then bent backward and the protrusion part 152*a* is coupled to the end of the rail connection part 152*b*. By the above-described structure, the protrusion part 152*a* is formed to be spaced from the side of the moving rail 150 by a predetermined distance.

In this case, the insertion member 152 and the opening apparatus 200 may be a push/pull type button. That is, through the button, when a push manipulation is conducted one time, the insertion member 152 is coupled to the opening apparatus 20, and when the push manipulation is again conducted one time, the insertion member 152 is separated from the opening apparatus 20. Embodiments of the structure of the insertion member 152 and the opening apparatus 200 to which the principle of the push/pull type button is applied are described in detail with reference to the drawings.

Figure 7:
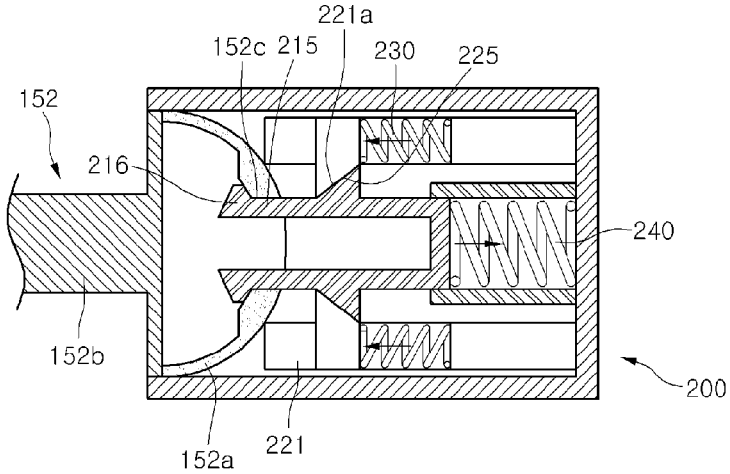
FIG. 7 is a transverse cross-sectional view showing the coupled state of the opening apparatus and an insertion member according to an embodiment of the present invention.

FIG. 7 is a transverse cross-sectional view showing the coupled state of the opening apparatus and an insertion member according to an embodiment of the present invention.

Referring to FIG. 7, an opened part 152*c* opened toward the front thereof in which the engagement member 215 is received is formed in the protrusion part 512*a* of the insertion member 152. Furthermore, engagement ends 216 which are engaged with the inner surface of the protrusion part 512*a* are formed in the engagement member 215. The engagement member 215 may be a rib having the shape of "⊂" such that the ends of the engagement member 215 are elastically deformed in a direction approaching each other.

The engagement members 215 may be elastically deformed in a direction approaching each other when the engagement members 215 are received in the protrusion part 152*a*.

The engagement end 216 has a inclined surface such that the engagement member 215 is easily inserted into the opened part 215*c*. Furthermore, the inner surface of the protrusion part 152*a* which is engaged with the engagement ends 216 has an inclined surface corresponding to the engagement ends 216.

When the insertion member 152 is inserted into the opening apparatus 200, the engagement ends 216 are inserted into the inside of the protrusion part 152*a* while being guided along the opened part 512*c*. In this case, the plurality of the engagement members 215 may be elastically deformed in a direction approaching each other.

When the pressing portion 103 is pushed in order to draw in the storage box 100, the moving rail 150 is drawn in the inside of the refrigerating compartment 30 along the fixing rail 130, and the insertion member 152 is inserted into the inside of the opening apparatus 200. Furthermore, when the engagement members 215 have been completely inserted into the inside of the protrusion part 152*a*, the plurality of engagement members are restored in a direction opposite to the direction approaching each other and are engaged with the inner surface of the protrusion part 152*a*.

The opening apparatus 200 includes a pressuring part 221 which is pressured by the insertion member 152 and a first elastic member 230 which allows the elastic movement of the pressuring part 221 when the insertion member 152 is moved backward. The pressuring part 221 and the first elastic member 230 may be provided in plural number in the both sides of the inside of the opening apparatus 200.

The pressuring part 221 includes an inclined surface corresponding part 221*a* formed to be inclined in one direction. The engagement member 215 includes an inclined surface 225 which forms at least a part of the engagement member 215 and corresponds to the inclined surface corresponding part 221*a* and a second elastic member 240 which allows the engagement member 215 to be moved backward. In this case, the second elastic member 240 may be a tension spring which generates a restoring force in a direction in which the spring is contracted when an external force is removed and the first elastic member 230 may be a compression spring which generates a restoring force in a direction in which the spring is extended when an external force is removed.

Furthermore, when the engagement member 215 has been engaged with the protrusion part 512*a*, the second elastic member 240 has been tensioned and the restoring force has been accumulated. In order words, when the protrusion part 152*a* is inserted into the inside of the opening apparatus 200, the engagement member 215 is inserted into and engaged with the opened part 152*c* of the protrusion part 512*a* which being elastically deformed. Furthermore, when the insertion of the storage box 100 is completed and then the external force is removed, the insertion member 152 is slightly moved forwardly. Thereafter, the insertion member 152 pulls the engagement member 215, so that the second elastic member 240 is retained in the extended state.

Furthermore, since the first elastic member 230 is the compression spring, the first elastic member 230 is extended when the external force is removed, so that the pressuring part 221 is retained to be in contact with the protrusion part 152*a*. Due to the above-described configuration, the moving rail 150 can be coupled to the fixing rail 130 and the storage box 100 can be retained to be inserted into the refrigerating compartment 30.

Meanwhile, when the insertion member 152 has been coupled to the opening apparatus 200, the press manipulation may be again conducted one time on the storage box 100 in order to draw out the storage box 100.

Figure 8:
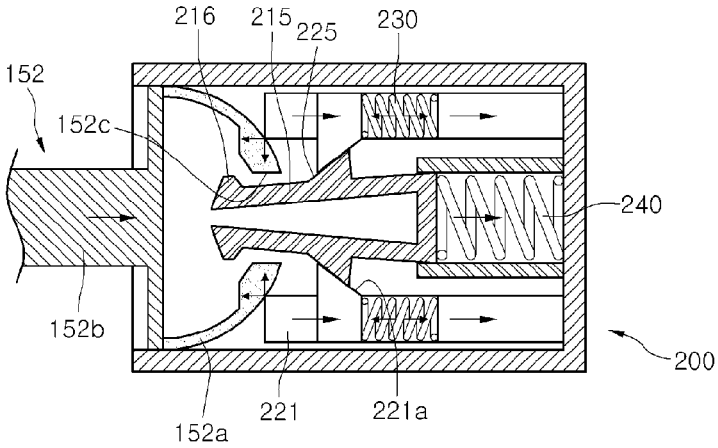
FIG. 8 is a transverse cross-sectional view showing the procedure in which the insertion member is separated from the opening apparatus.
Figure 9:
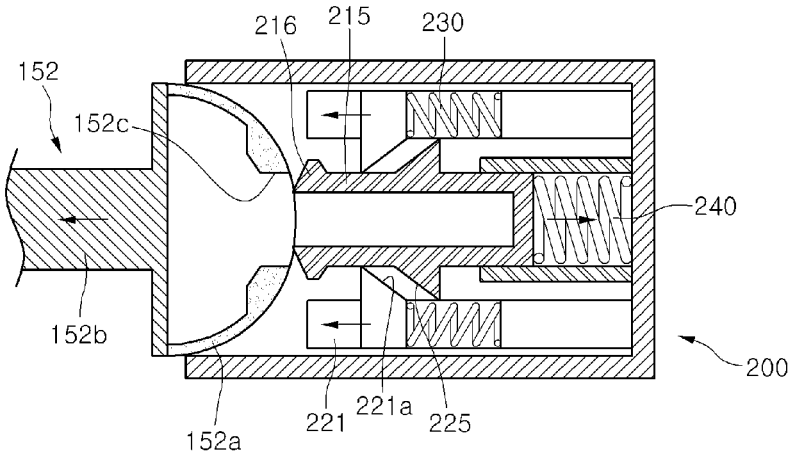
FIG. 9 is a transverse cross-sectional view showing the separated state of the opening apparatus and the insertion member according to an embodiment of the present invention.

FIG. 8 is a transverse cross-sectional view showing the procedure in which the insertion member is separated from the opening apparatus, and FIG. 9 is a transverse cross-sectional view showing the separated state of the opening apparatus and the insertion member according to an embodiment of the present invention.

Referring to FIG. 8, when the press manipulation is again conducted on the storage box 100, the moving rail 150 and the insertion member 152 are moved backward, that is, in the direction of the arrow of FIG. 8.

More specifically, when the insertion member 152 is moved backward, the insertion member 152 pushes the pressuring member 221 in the direction of the arrow and, at the same time, compresses the first elastic member 230. In this case, the pressuring member 221 is pulled back to pull the inclined surface corresponding part 221*a* back, and the engagement member 215 is elastically deformed due to the action between the inclined surface corresponding part 221*a* and the inclined surface 225. As shown in the drawing, the engagement members 215 are elastically deformed in the direction approaching each other and, accordingly, the coupling between the engagement ends 216 and the protrusion part 152*a* is released. At the same time, the second elastic member 240, which had been retained to be extended, is returned to its original position due to the restoring force to allow the engagement member 215 to be pulled back. Thereafter, the engagement member 215 is completely separated from the protrusion part 152*a* for a moment.

In this state, when the force acting on the storage box 100 is removed, the restoring force which is accumulated in the first elastic member 230 is exerted on the first elastic member 230, thereby the first elastic member 230 being extended. Furthermore, the pressuring member 221 which is located in front of the first elastic member 230 pushes the protrusion part 152*a* forwardly. Thereafter, due to the restoring force of the first elastic member 230, the insertion member 152 is bound off forward a predetermined distance by a predetermined distance thereby being in the state shown in FIG. 9. Furthermore, the storage box 100 is spaced forward from the storage space. In this state, a user can pull the storage box 100 forward to be drawn out.

As described above, the storage box 100 can be drawn in the refrigerating compartment 30 due to a first pressure acting thereon and be easily drawn out due to a second pressure acting thereon. As a result, a difficulty in which the user applies a great force in order to draw in and out the storage box 100 can be resolved.

Meanwhile, the insertion member 152 and the opening apparatus 200 may be mounted in different positions beside the moving rail 150 and the fixing rail 130. For example, the insertion member 152 may protrude from the rear surface of the storage box 100 and the opening apparatus 200 may be formed in the wall surface of the rear of the refrigerating compartment 30. Furthermore, the opening apparatus 200 may be provided not only to protrude from the wall surface of the rear of the refrigerating compartment 30, but also to be buried in the wall surface. In the latter case, the insertion part 210 may be only exposed to the outside.

The process in which the storage box 100 is separated form the moving rail 150 is described in detail below with reference to the drawings. Herein, it is noted that the process in which the storage box 100 is separated form the moving rail 150 is conducted in the state in which the insertion member 152 is separated from the opening apparatus 200 and the moving rail 150 is drawn off forward, that is, the storage box 100 is drawn off from the front of the refrigerating compartment 30.

Figure 10:
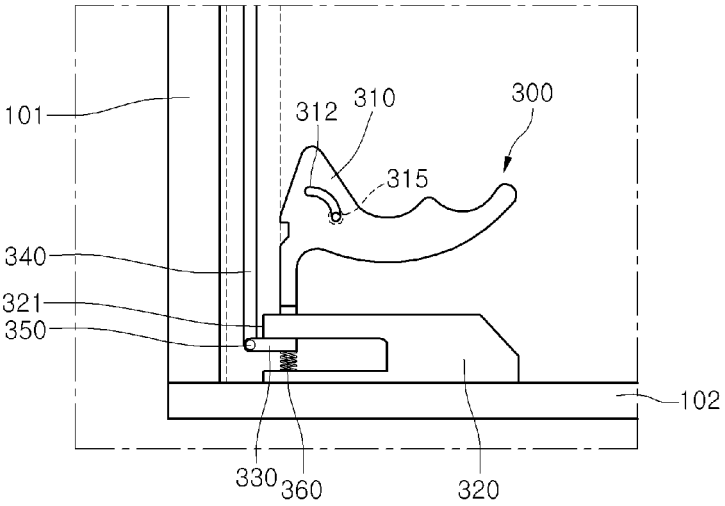
FIG. 10 is a diagram showing a configuration of a separating apparatus according to an embodiment of the present invention.
Figure 11:
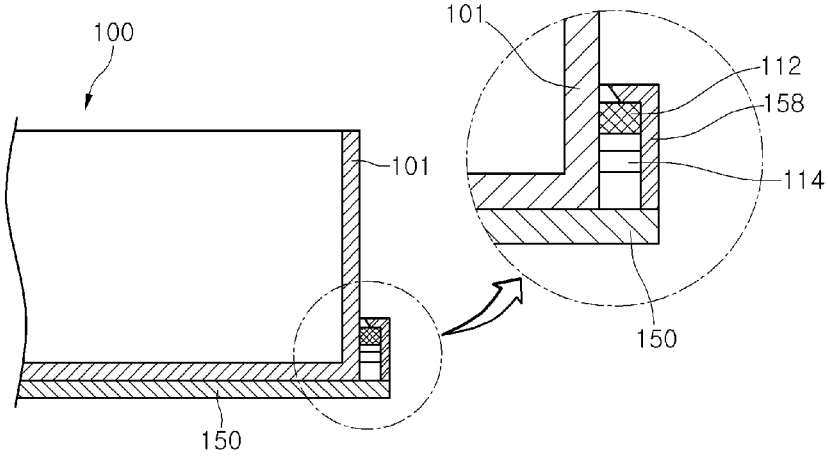
FIG. 11 is a cross-sectional view showing the coupling state of a rear engaging portion and an engagement rib according to an embodiment of the present invention.
Figure 12:
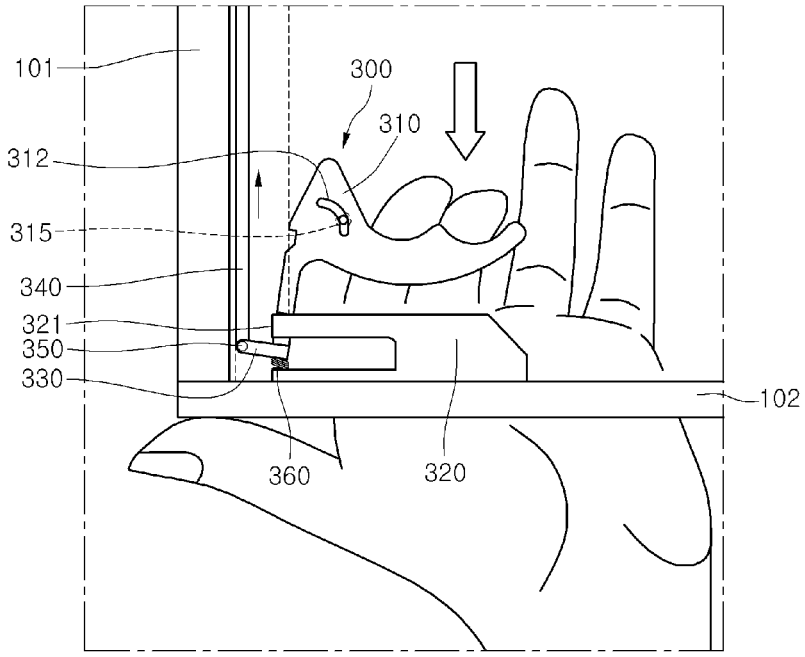
FIG. 12 is a diagram showing the operation state of the separating apparatus according to an embodiment of the present invention.
Figure 13:
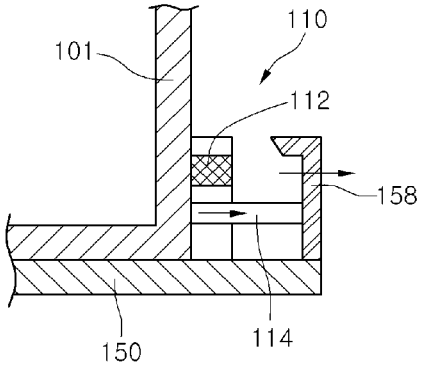
FIG. 13 is a cross-sectional view showing the separated state of the rear engaging portion and the engagement rib according to an embodiment of the present invention.

FIG. 10 is a diagram showing a configuration of a separating apparatus according to an embodiment of the present invention, FIG. 11 is a cross-sectional view showing the coupling state of a rear engaging portion and an engagement rib according to an embodiment of the present invention, FIG. 12 is a diagram showing the operation state of the separating apparatus according to an embodiment of the present invention, and FIG. 13 is a cross-sectional view showing the separated state of the rear engaging portion and the engagement rib according to an embodiment of the present invention.

Referring to FIG. 10, a separating apparatus 300 that separates the storage box 100 from the moving rail 150 is mounted in the lower portion of the storage box 100 according to the embodiment of the present invention.

Specifically, the separating apparatus 300 includes a handle 310 which is griped by the user to be manipulated, link members 330 and 340 which are movable by the manipulation of the handle 310 and a coupler 320 which allows the handle 310 to be coupled to the lower surface portion 101*a* of the storage box 100.

More specifically, since the separating apparatus 300 is mounted in the lower surface of the storage box 100, the storage box 100 can be griped and manipulated by the user in the state in which the storage box 100 is drawn out from the refrigerating compartment 30 and is exposed to the outside of the refrigerator.

The handle 310 includes a guide groove 312 that guides the rotation of the handle 310 and a fastening protrusion 315 that is received in the guide groove 312 and is coupled to the lower surface portion 101*a*. The fastening protrusion 315 may protrudes downward from the lower surface portion 101*a* and be inserted into the guide groove 312.

As shown in the drawings, in the state in which the handle 310 has not been rotated, the fastening protrusion 315 is located at the right lower end of the guide groove 312. Furthermore, as shown in FIG. 11, when the handle 310 is rotated, the fastening protrusion 315 is moved along the guide groove 312 up to the left upper end thereof.

As the link members 330 and 340, there are a first link member 330 coupled to the one end of the handle 310 and a second link member 340 extended forward from the first link member 330. Furthermore, the first link member 330 and the second link member 340 are coupled to each other to be rotated by the link coupling part 350.

The coupler 320 may be provided with a spring 360 as an elastic member that elastically supports the first link member 330. The one end of the spring 360 may be fixed to the receptacle body 101 and the other end may be fixed to the first link member 330. Specifically, the lower end of the receptacle front portion 102 that forms the front of the receptacle body 101 may protrude downward slightly farther than the lower surface portion 101*a* of the receptacle body 101, and the coupler 320 is coupled to the rear surface of the protrusion portion of the receptacle front portion 102. Furthermore, one end of the spring 360 may be fixed to the rear surface of the receptacle front portion 102.

When the first link member 330 is moved forward or backward by the manipulation of the handle 310, the spring 360 supports the first link member 330.

Referring to FIG. 11, the push protrusion 114 that selectively presses the engagement rib 158 is coupled to the rear end of the second link member 340. In the state in which the storage box 100 has been coupled to the moving rail 150, the push protrusion 114 is retained to be in contact with the front of the engagement rib 158.

Meanwhile, the separating apparatus 300 has to be manipulated in order for separation of the storage box 100.

Referring to FIG. 12, the handle 310 may be rotated around the link coupling part 350 in a predetermined direction. That is, the handle 310 may be rotated around the link coupling part 350 in a clockwise direction. In this process, the first link member 330 is also rotated in the clockwise direction, and the spring 360 is compressed.

When the first link member 330 is rotated, the force that is applied from the rear side (the upper side in the drawing) acts on the link coupling part 350 and, accordingly, the second link member 340 is moved backward a predetermined distance.

Furthermore, a stopper 321 which passes through at least a part of the handle 310 and limits the rotation range of the handle 310 may be formed in the coupler 320. Furthermore, a hole that passes through the stopper 321 may be formed in an oval shape such that the longitudinal axis thereof is defined in the front-end direction of the storage box 100. Furthermore, in the state in which the handle 310 has been not manipulated, the lower end of the stopper 321 is in contact against the handle 310 as shown in FIG. 9. That is, the stopper 321 is in contact against the front end of the hole. Furthermore, in the state in which the handle 310 has been manipulated, the upper end of the stopper 321 is in contact against the handle 310 as shown in FIG. 11. That is, the stopper 321 is in contact against the rear end of the hole. Accordingly, the range in which the handle 310 can be manipulated (rotated) may correspond to the spaced distance between the handle 310 and the stopper 321, that is, the length of the longitudinal axis of the oval shaped hole.

Referring to FIG. 13, when the second link member 340 is moved backward a predetermined distance by manipulating the handle 310, the push protrusion 114 is moved backward to press the engagement rib 158.

In this process, the engagement of the rear engaging portion 110 and the engagement end 112 is released, and the storage box 100 can be separated from the engagement rib 158 while moving forward. In alternative embodiment, the end of the second link member 340 may be directly in close contact with the engagement rib 158.

Furthermore, in the state in which the rear engaging portion 110 has been separated from the engagement rib 158, the storage box 100 is completely separated from the moving rail 150 by raising the storage box 100 upward.

Herein, it is noted that the separation process of the storage box 100 by the manipulation of the separating apparatus 300 is conducted when the engagement rib 155 that protrudes from the moving rail and the coupling groove 105 that is formed on the lower surface of the storage box 100 are not provided.

The invention claimed is:

1. A refrigerator comprising:

a main body configured to define a storage chamber;

a main door rotatably coupled to the main body;

a sub door provided between the main body and the main door and rotatably coupled to the main body, the main door being rotatable independently of the sub door and the sub door being rotated along with the main door;

a storage box received in the storage chamber to be drawn out therefrom;

a fixing rail fixed to one side of the storage chamber;

a moving rail provided to be movable along the fixing rail and moving along with the storage box; and a restrainer provided in one side of a part configured to move integrally along with the storage box and in one side of a part formed integrally with the storage chamber and configured to allow the storage box to be selectively drawn out from the storage chamber when the storage box is pressed, the restrainer comprising an opener including an engagement member and an insertion member selectively engaged with the engagement member, and wherein the opener includes:

a pressuring part configured to press the insertion member to be separated from the opener;

a first elastic member configured to provide a pressure on the pressuring part; and a second elastic member coupled to the engagement member to generate a force pulling the engagement member.

2. The refrigerator of claim 1, wherein any one of the opener and the insertion member is provided in the moving rail or the storage box, and the other of the opener and the insertion member is provided in any one of the fixing rail and a wall surface of the storage chamber.

3. The refrigerator of claim 2, wherein the insertion member includes a protrusion part selectively engaged with the engagement member.

4. The refrigerator of claim 1, wherein the first elastic member includes a compression spring, and the second elastic member includes a tension spring.

5. The refrigerator of claim 1, wherein the engagement member is elastically deformed when being coupled to or separated from the insertion member, the engagement member has an inclined surface protruding therefrom, and the pressuring part has an inclined surface corresponding part protruding therefrom, wherein the inclined surface corresponding part is configured to press the inclined surface while moving along the inclined surface such that the engagement member is elastically deformed.

6. The refrigerator of claim 1, further comprising a coupling rib protruding from the moving rail; and a coupling groove formed in a lower surface of the storage box, wherein the coupling rib is configured to he inserted into the coupling groove.

7. The refrigerator of claim 1, wherein the sub door includes:

a frame; and a basket fixedly or removably coupled to the frame,

8. The refrigerator of claim 7, wherein the main door and the sub door share a single rotating axis.

9. The refrigerator of claim 7, further comprising a handle protruding from a front of the sub door, wherein the main door comprises a plurality of main doors provided in the front of the sub door.

10. The refrigerator of claim 9, wherein the handle is shielded by the main door when the main door has been closed.

* * * * *